US009283464B2

(12) United States Patent
Nipper et al.

(10) Patent No.: US 9,283,464 B2
(45) Date of Patent: Mar. 15, 2016

(54) GOLF GAMING SYSTEMS AND METHODS

(75) Inventors: J. Matthew Nipper, San Diego, CA (US); Mark Whitebook, Capistrano Beach, CA (US); George Sutton, La Jolla, CA (US); Lyle Powers, Boulder, CO (US)

(73) Assignee: LYNQS, INC., San Diego, CA (US)

( * ) Notice: Subject to any disclaimer, the term of this patent is extended or adjusted under 35 U.S.C. 154(b) by 873 days.

(21) Appl. No.: 12/185,013

(22) Filed: Aug. 1, 2008

(65) Prior Publication Data

US 2009/0036237 A1 Feb. 5, 2009

Related U.S. Application Data

(60) Provisional application No. 60/935,295, filed on Aug. 3, 2007.

(51) Int. Cl.

| | |
|---|---|
| ***A63B 69/36*** | (2006.01) |
| ***A63B 24/00*** | (2006.01) |
| ***A63B 67/00*** | (2006.01) |
| ***A63B 67/02*** | (2006.01) |

(52) U.S. Cl.

CPC ..... *A63B 69/3658* (2013.01); *A63B 24/0021* (2013.01); *A63B 2024/004* (2013.01); *A63B 2024/005* (2013.01); *A63B 2024/0028* (2013.01); *A63B 2024/0031* (2013.01); *A63B 2024/0034* (2013.01); *A63B 2024/0037* (2013.01); *A63B 2024/0043* (2013.01); *A63B 2024/0046* (2013.01); *A63B 2024/0053* (2013.01); *A63B 2024/0056* (2013.01); *A63B 2225/54* (2013.01)

(58) Field of Classification Search

CPC ..... A63B 24/0021; A63B 69/3658; A63B 2024/0028; A63B 2024/0031; A63B 2024/0037; A63B 2024/004; A63B 2024/0043; A63B 2024/0046; A63B 2024/005; A63B 2024/0053; A63B 2024/0056; A63B 2225/54

USPC ..... 473/131, 150–156, 199, 406, 409

See application file for complete search history.

(56) References Cited

U.S. PATENT DOCUMENTS

| | | | | | |
|---|---|---|---|---|---|
| 4,676,397 | A | * | 6/1987 | Hoffmeister | 221/105 |
| 5,245,537 | A | * | 9/1993 | Barber | 473/403 |
| 5,283,733 | A | * | 2/1994 | Colley | 340/323 R |
| 5,303,924 | A | * | 4/1994 | Kluttz et al. | 473/155 |
| 5,437,457 | A | * | 8/1995 | Curchod | 473/199 |
| 5,486,002 | A | * | 1/1996 | Witler et al. | 473/199 |
| 5,507,485 | A | * | 4/1996 | Fisher | 473/407 |
| 5,558,333 | A | * | 9/1996 | Kelson et al. | 473/131 |
| 5,691,922 | A | * | 11/1997 | McEwan et al. | 702/158 |
| 5,700,204 | A | * | 12/1997 | Teder | 473/199 |
| 5,740,077 | A | * | 4/1998 | Reeves | 473/407 |
| 5,797,805 | A | * | 8/1998 | Lubell et al. | 473/266 |
| 6,059,672 | A | * | 5/2000 | Zeiner-Gundersen | 473/407 |
| 6,074,312 | A | * | 6/2000 | Lyon et al. | 473/409 |
| 6,171,199 | B1 | * | 1/2001 | Cohodas et al. | 473/131 |
| 6,186,002 | B1 | * | 2/2001 | Lieberman et al. | 73/432.1 |

(Continued)

*Primary Examiner* — William H McCulloch, Jr.

(74) *Attorney, Agent, or Firm* — Birch, Stewart, Kolasch & Birch, LLP

(57) ABSTRACT

The present inventions relate to golf gaming systems and methods for evaluating a golfer's performance and facilitating golf gaming and competition. Specifically, The present invention provides methods, locations, installations, devices and systems adapted and arranged for observing, processing, analyzing and communicating data and images of individual or group golf gaming performance with respect to golf balls in play in three-dimensional environments.

17 Claims, 10 Drawing Sheets

(56) References Cited

U.S. PATENT DOCUMENTS

| | | | | |
|---|---|---|---|---|
| 6,244,971 | B1 * | 6/2001 | Mihran | 473/200 |
| 6,296,579 | B1 * | 10/2001 | Robinson | 473/407 |
| 6,537,076 | B2 * | 3/2003 | McNitt et al. | 434/252 |
| 6,547,671 | B1 * | 4/2003 | Mihran | 473/131 |
| 6,638,173 | B2 * | 10/2003 | Robinson | 473/131 |
| 6,671,642 | B2 * | 12/2003 | Miyamoto et al. | 702/109 |
| 7,095,312 | B2 * | 8/2006 | Erario et al. | 340/323 R |
| 7,121,962 | B2 * | 10/2006 | Reeves | 473/407 |
| 7,321,330 | B2 * | 1/2008 | Sajima | 342/59 |
| 7,662,047 | B2 * | 2/2010 | Ueshima et al. | 473/199 |
| 7,789,767 | B2 * | 9/2010 | Lindsay | 473/251 |
| 7,837,572 | B2 * | 11/2010 | Bissonnette et al. | 473/151 |
| 8,133,124 | B2 * | 3/2012 | Braun et al. | 473/131 |
| 8,172,680 | B2 * | 5/2012 | Yasuoka et al. | 463/36 |
| 8,257,189 | B2 * | 9/2012 | Koudele et al. | 473/155 |
| 8,303,311 | B2 * | 11/2012 | Forest | 434/252 |
| 2002/0038178 | A1 * | 3/2002 | Talkenberg et al. | 701/200 |
| 2003/0017890 | A1 * | 1/2003 | McDonald et al. | 473/407 |
| 2003/0040373 | A1 * | 2/2003 | Chamberlain et al. | 473/132 |
| 2004/0073325 | A1 * | 4/2004 | Reeves | 700/91 |
| 2006/0030429 | A1 * | 2/2006 | Rankin | 473/407 |
| 2006/0084529 | A1 * | 4/2006 | Burkons | 473/409 |
| 2006/0166738 | A1 * | 7/2006 | Eyestone et al. | 463/36 |
| 2007/0129178 | A1 * | 6/2007 | Reeves | 473/407 |
| 2007/0167247 | A1 * | 7/2007 | Lindsay | 473/131 |
| 2009/0036237 | A1 * | 2/2009 | Nipper et al. | 473/409 |
| 2012/0108364 | A1 * | 5/2012 | Hasegawa et al. | 473/409 |
| 2012/0190469 | A1 * | 7/2012 | Arakawa et al. | 473/199 |
| 2012/0202610 | A1 * | 8/2012 | Voges et al. | 473/199 |
| 2012/0220385 | A1 * | 8/2012 | Richardson et al. | 473/156 |
| 2012/0238380 | A9 * | 9/2012 | Marty et al. | 473/407 |
| 2012/0264532 | A1 * | 10/2012 | Rankin | 473/199 |
| 2012/0277036 | A1 * | 11/2012 | Lee | 473/409 |
| 2012/0309553 | A1 * | 12/2012 | Koudele et al. | 473/199 |
| 2013/0316839 | A1 * | 11/2013 | Woo et al. | 473/156 |
| 2014/0004967 | A1 * | 1/2014 | Jang et al. | 473/152 |
| 2014/0004968 | A1 * | 1/2014 | Jang et al. | 473/156 |
| 2014/0004969 | A1 * | 1/2014 | Jang et al. | 473/156 |
| 2015/0182837 | A1 * | 7/2015 | Burke | 473/225 |

* cited by examiner

Full shot model outputs

GOLF GAMING SYSTEMS AND METHODS

CROSS REFERENCE TO RELATED APPLICATION(S)

This application claims the benefit of priority under 35 U.S.C. §119(e) of U.S. Ser. No. 60/935,295, filed Aug. 3, 2007, the entire content of which is incorporated herein by reference.

BACKGROUND OF THE INVENTION

1. Field of the Invention

The invention relates generally to the game of golf and more specifically to improvements in golf gaming systems allowing groups of golfers to play competitive golf using full length shots in minutes instead of hours. In specific, the present invention relates to methods, locations, installations, devices and systems adapted and arranged for observing, processing, analyzing and communicating data and images of individual or group golf gaming performance with respect to golf balls in play in three-dimensional environments.

2. Background Information

The game of golf is enjoyed world-wide by both men and women from a variety of diverse cultures. Recent estimates indicate that there are currently over 32,000 golf courses in the world with approximately half being in the United States. Despite the popularity of the sport, it is estimated that in the United States, the number of people who play golf 25 times or more per year fell from 6.9 million in 2000 to 4.6 million in 2005. A smaller decline in the number who played golf at all was also reported, falling from 30 million to 26 million over the same period. The golf industry has identified time as the biggest barrier to participation in the sport.

A number of venues have been offered for individuals who cannot find the time to play a traditional round of golf but would like the satisfaction of doing so. For example, several driving ranges which include features to simulate a real round of golf and other golf simulation platforms have been previously described. However, there are four critical functions that a venue must perform in order to reasonably duplicate the golfing experience. Those include: accurately measure a full length golf shot taken in the "real world"; measure many shots simultaneously taken from many tee boxes; provide measurements for all shots without requiring the shot to hit a target; and differentiating between carry and roll so that the experience of playing across hazards (as found while playing a golf course) can be faithfully re-created.

Unfortunately, a system that provides these basic capabilities has yet to be described. Thus there is a need for an improved golf gaming system that offers time convenience while more accurately re-creating real golf play on the course of the player's choice and additionally allowing multiple players to compete.

SUMMARY OF THE INVENTION

The present invention provides a golf gaming system capable of accurately re-creating golf play and competition on multiple known courses with multiple players in a three-dimensional environment.

The invention relates generally to the game of golf and more specifically to improvements in golf gaming systems allowing for more accurate re-creation of the traditional game and dynamic competition between multiple players. In specific, the present invention relates to methods, locations, installations, devices and systems adapted and arranged for observing, processing, analyzing and communicating data and images of individual or group golf gaming performance with respect to golf balls in play in three-dimensional environments.

The present inventions integrate a launch monitoring system with a ball trajectory or flight modeling algorithm, operating with respect to data sets obtained from one or more launch monitors, to predict the flight path and landing position of a struck golf ball. This prediction is then used to identify with specificity the one struck ball of a particular player from all other balls which land in a target area or zone. These, and other, data sets are thereby used to filter out, and thereby exclude, all other balls in that area or zone from the struck ball being tracked. In another aspect, the inventions provide one or more impact detection systems, grids or sensor arrays to detect the impact of the struck ball. The impact data sets are integrated and compared with the struck ball/trajectory data sets (i.e., the calculated flight model) to confirm the identity of the specific ball, and to match it with the particular player who struck that specific ball. These integrated data filter systems and processes are software-mediated and provide predictive and detected data redundancy to such a high degree that, ball-to-player matches, and ball to stroke matches, are instantaneous and virtually error-free.

Accordingly, in one aspect the present invention provides a method for evaluating a golfer's performance and facilitating a golf game. The method includes: a) providing a golfing installation that includes a tee area incorporating a launch monitoring system (LMS) and a target field incorporating an impact detection system (IDS) that is configured as a network of one or more sensors of the same or different type, disposed within or proximate to the target field; b) detecting via the LMS one or more parameters of a golf ball struck by a golf club within the tee area, one or more parameters of a golf club swing used to hit the golf ball, or any combination thereof; c) analyzing via software for flight modeling the one or more parameters of the golf ball, the golf club swing, or any combination thereof, to determine a flight model comprising a predicted trajectory, a predicted landing position, and a predicted landing time of the golf ball; d) gathering impact data via the IDS, including a landing position and an impact time for each ball that impacts within the network; e) correlating the flight model with the impact data to determine a true impact position for the golf ball; f) generating additional positional data for the golf ball by analyzing the flight model and the true impact position; g) integrating the flight model, the true impact position and the additional positional data to generate a set of integrated performance data; and h) generating a representation of the integrated performance data and presenting the representation.

In another aspect, the present invention provides a method for evaluating, comparing and discriminating between a first golfer's performance and at least one second golfer's performance to facilitate a golf game. The method includes: a) providing a golfing installation that includes at least a first and second tee area, each incorporating a launch monitoring system (LMS), and a target field incorporating an impact detection system (IDS) that is configured as a network of one or more sensors of the same or different type, disposed within or proximate to the target field; b) detecting via the LMS one or more parameters of a first golf ball struck by a first golf club within the first tee area, one or more parameters of a swing of the first golf club used to hit the first golf ball, or any combination thereof; c) detecting via the LMS one or more parameters of a second golf ball struck by a second golf club within the first or a second tee area, one or more parameters of a swing of the second golf club used to hit the second golf ball, or any combination thereof; d) analyzing via software for flight modeling the one or more parameters of the first golf ball, the swing of the first golf club, or any combination thereof, to calculate a first flight model comprising a predicted trajectory, a predicted landing position, and a predicted landing time of the first golf ball; e) analyzing via software for flight modeling the one or more parameters of the second golf ball, the swing of the second golf club, or any combination thereof, to calculate a second flight model comprising a predicted trajectory, a predicted landing position, and a predicted landing time of the second golf ball; f) gathering impact data via the IDS, including a landing position and an impact time for each ball that impacts within the network; g) correlating the first and second flight model with the impact data to determine a true impact position for the first golf ball and the second golf ball; h) generating additional positional data for the first golf ball and the second golf ball by analyzing the first and second flight models and the true impact positions for the first golf ball and the second golf ball; i) integrating the first and second flight models, the true impact positions for the first golf ball and the second golf ball and additional positional data for the first golf ball and the second golf ball to generate a set of integrated performance data for the first golf ball and the second golf ball; j) comparing the integrated performance data of the first golf ball with the integrated performance data of the second golf ball to discriminate between the performance of the first golfer and second or additional golfer; and k) generating a representation of the results of step i), step j) or any combination thereof, and presenting the representation.

DETAILED DESCRIPTION OF THE INVENTION

Figure 1:
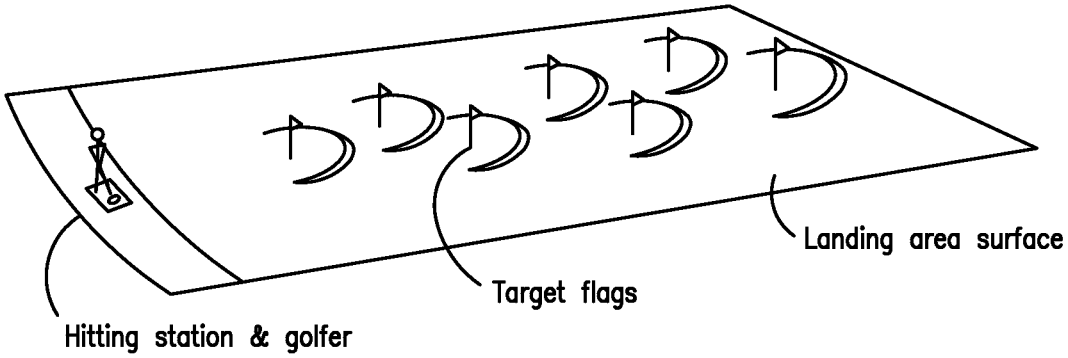
FIG. 1 is a pictorial representation of a golf installation including a tee area and target field with targets.

The present invention relates to installations, apparatus, software, gaming methods and business methods for facilitating golfing games, and for determining a golfer's detailed performance in such sporting games, such as in a competition with one or more local players, or individually as in a particular game or using a particular club, such as a specific iron or wood. In accordance with the inventions, software is adapted and arranged to perform a number of key functions with respect to observing, analyzing, predicting and recording the performance of one or multiple players.

Before the present invention is further described, it is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

In various aspects of the invention, data regarding the struck ball of a first player is instantly filtered from the data regarding other ("extraneous") balls struck by other players. This filtering is effected via both software and launch detection means such that the timing, integrity and quality of the feedback information provided to each golfer is superior to other methods and installations currently known in the art.

In other aspects, using a ball launch monitor system at the tee site, and employing software capable of generating a struck ball's flight model, the invention gathers and integrates data regarding one or more parameters that influence the flight path of the struck ball, such as the ball's vertical and horizontal launch angles, launch velocity components, aerodynamic flight properties such as ball spin velocity and direction, measured wind direction and velocity, and current air density to predict the flight path and likely landing location for the ball. As discussed in detail below, a launch monitor system (LMS) for use in the present invention may comprise one or more of a variety of sensors and sensor types, such as both an optical sensor net and acoustical detectors for detecting and communicating to one or more data processors, the movement parameters of the struck golf ball as it is struck at the tee site. The data thus gathered with respect to the ball of a first player is instantly filtered from the data regarding the struck balls of other players.

Immediately upon impact of the struck ball in a landing zone, the launch data is combined with data from all, or a portion of the sensor grid, and processed to determine the golfer's actual and comparative performance. Predictive scores, such as statistical short-game estimates of how many putts would be required to sink a ball in the cup from its initial position on the green, can also be provided as game values. Numerous graphic displays can be presented before, during and after a shot or game in order to provide scoring, performance feedback, and to increase participation, excitement and competition.

In one aspect, the system of the present invention instantaneously presents data regarding the performance of a first player with each stroke. Thus, as soon as the ball is struck by the first player, that is, within milliseconds (or no more than a second), data regarding the player's performance on that stroke is made available in several different ways. For example, that first player stroke data can be immediately presented as one or more graphic images, or video squirts, while the ball is still in the air. In one aspect, systems of the present invention can thus present virtually a number of parameters of the ball's flight. Such parameters include the likely trajectory of the ball, it's likely impact point on the course, and the likely bounce and roll characteristics of the ball.

Accordingly, the present invention provides means, methods and software suites adapted and arranged to immediately collect, process and present performance data regarding the golfing and gaming performance of one or more players in an environment which combines both real and virtual aspects.

It another aspect the invention provides means, methods and software which are adapted and arranged to facilitate gaming between and among participant players who may be located near one another, or at great distances from one another, either in real time or in software and network-facilitated delayed contests against real, historical or actual players.

In yet an additional aspect of the present invention means, methods and software suites adapted and arranged to provide a realistic golfing experience, while enabling the instantaneous evaluation and recordation of skills, performance and achievements in a controlled environment are provided.

Accordingly, numerous embodiments of the inventions exist. Depending on the particular context in which any of the inventions are used, any of the embodiments could be a preferred embodiment. For example, in one aspect, a method for evaluating a single golfer's performance at a golfing installation is provided. As such, in one aspect, the present invention provides a method for evaluating a single golfer's performance and facilitating a golf game between one or more golfers. The quantitative and qualitative evaluation of the golfer's performance may be used to facilitate gaming between one or more golfers.

The method includes: a) providing a golfing installation that includes a tee area incorporating a launch monitoring system (LMS) and a target field incorporating an impact detection system (IDS) that is configured as a network of one or more sensors of the same or different type, disposed within or proximate to the target field; b) detecting via the LMS one or more parameters of a golf ball struck by a golf club within the tee area, one or more parameters of a golf club swing used to hit the golf ball, or any combination thereof; c) analyzing via software for flight modeling the one or more parameters of the golf ball, the golf club swing, or any combination thereof, prior to the golf ball being struck, during contact with the golf ball, or while the golf ball is in flight to determine a flight model comprising a predicted trajectory, a predicted landing position, and a predicted landing time of the golf ball; d) gathering impact data via the IDS, including a landing position and an impact time for each ball that impacts within the network; e) correlating the flight model with the impact data to determine a true impact position for the golf ball; f) generating additional positional data for the golf ball by analyzing the flight model and the true impact position; g) integrating the flight model, the true impact position and the additional positional data to generate a set of integrated performance data; and h) generating a representation of the integrated performance data and presenting the representation.

The present invention further contemplates evaluating, comparing and discriminating between a first golfer's performance and at least one second golfer's performance in simultaneous fashion to facilitate a golf game. Accordingly, in another aspect, the present invention provides a method for evaluating, comparing and discriminating between a first golfer's performance and at least one second golfer's performance to facilitate a golf game. The method includes: a) providing a golfing installation that includes at least a first and second tee area, each incorporating a launch monitoring system (LMS), and a target field incorporating an impact detection system (IDS) that is configured as a network of one or more sensors of the same or different type, disposed within or proximate to the target field; b) detecting via the LMS one or more parameters of a first golf ball struck by a first golf club within the first tee area, one or more parameters of a swing of the first golf club used to hit the first golf ball, or any combination thereof; c) detecting via the LMS one or more parameters of a second golf ball struck by a second golf club within the first or a second tee area, one or more parameters of a swing of the second golf club used to hit the second golf ball, or any combination thereof; d) analyzing via software for flight modeling the one or more parameters of the first golf ball, the swing of the first golf club, or any combination thereof, prior to the first golf ball being struck, during contact with the first golf ball, or while the first golf ball is in flight to calculate a first flight model comprising a predicted trajectory, a predicted landing position, and a predicted landing time of the first golf ball; e) analyzing via software for flight modeling the one or more parameters of the second golf ball, the swing of the second golf club, or any combination thereof, prior to the second golf ball being struck, during contact with the second golf ball, or while the second golf ball is in flight to calculate a second flight model comprising a predicted trajectory, a predicted landing position, and a predicted landing time of the second golf ball; f) gathering impact data via the IDS, including a landing position and an impact time for each ball that impacts within the network; g) correlating the first and second flight model with the impact data to determine a true impact position for the first golf ball and the second golf ball; h) generating additional positional data for the first golf ball and the second golf ball by analyzing the first and second flight models and the true impact positions for the first golf ball and the second golf ball; i) integrating the first and second flight models, the true impact positions for the first golf ball and the second golf ball and additional positional data for the first golf ball and the second golf ball to generate a set of integrated performance data for the first golf ball and the second golf ball; j) comparing the integrated performance data of the first golf ball with the integrated performance data of the second golf ball to discriminate between the performance of the first golfer and second or additional golfer; and k) generating a representation of the results of step i), step j) or any combination thereof, and presenting the representation.

The launch monitor system (LMS) for use with the present inventions may be adapted and arranged to make observations and gather data created when a player uses a golf club to strike a ball, and the ball accelerates off a tee. As such, the LMS is configured to monitor and collect one or more parameters of a struck ball from a tee area or one or more parameters of a swing of the golf club used to strike the ball. The data generated by the LMS is processed via flight modeling software to generate a flight model for the struck ball so that predictions may be made, such as a predicted trajectory, a predicted landing position, and a predicted landing time. Several types and models of LMSs are contemplated for use with the present inventions. In various aspects, the LMS includes a hardware component of the system.

Figure 2:
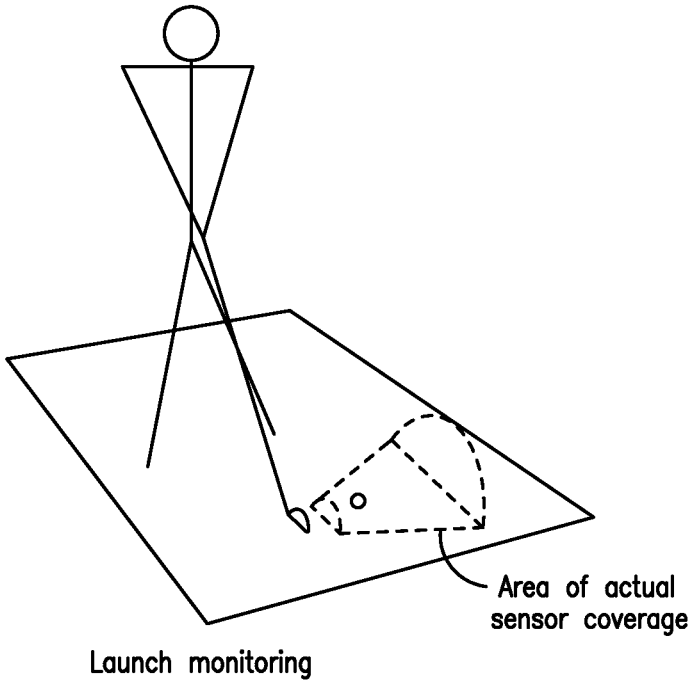
FIG. 2 is a pictorial representation of a tee area including a launch monitor.
Figure 3:
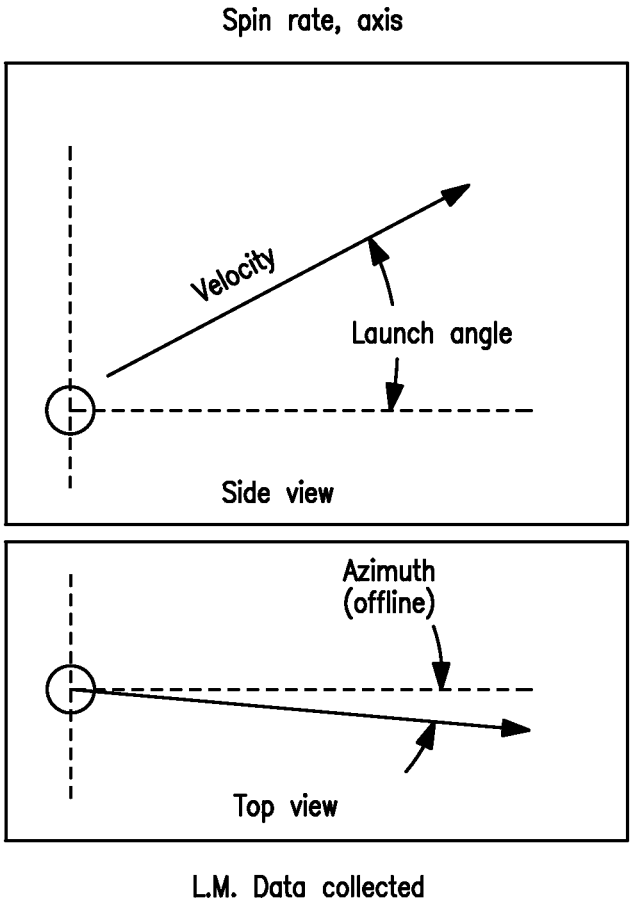
FIG. 3 shows sample data collected by the launch monitor.
Figure 4:
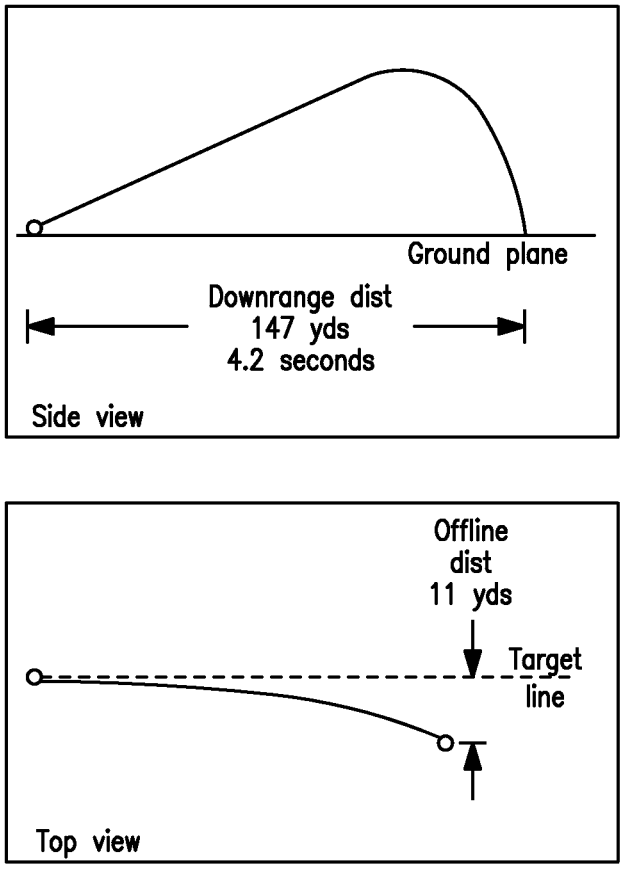
FIG. 4 is a pictorial representation of a three-dimensional model of a full golf shot.
Figure 5:
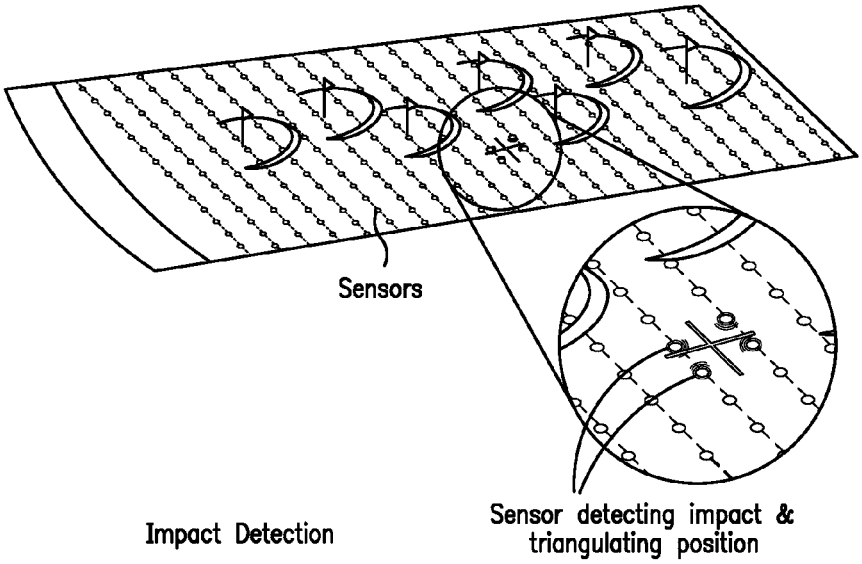
FIG. 5 is a pictorial representation of a target field including an impact detection system with numerous sensors used to collect impact data to determine actual impact positions and times by triangulation.
Figure 6:
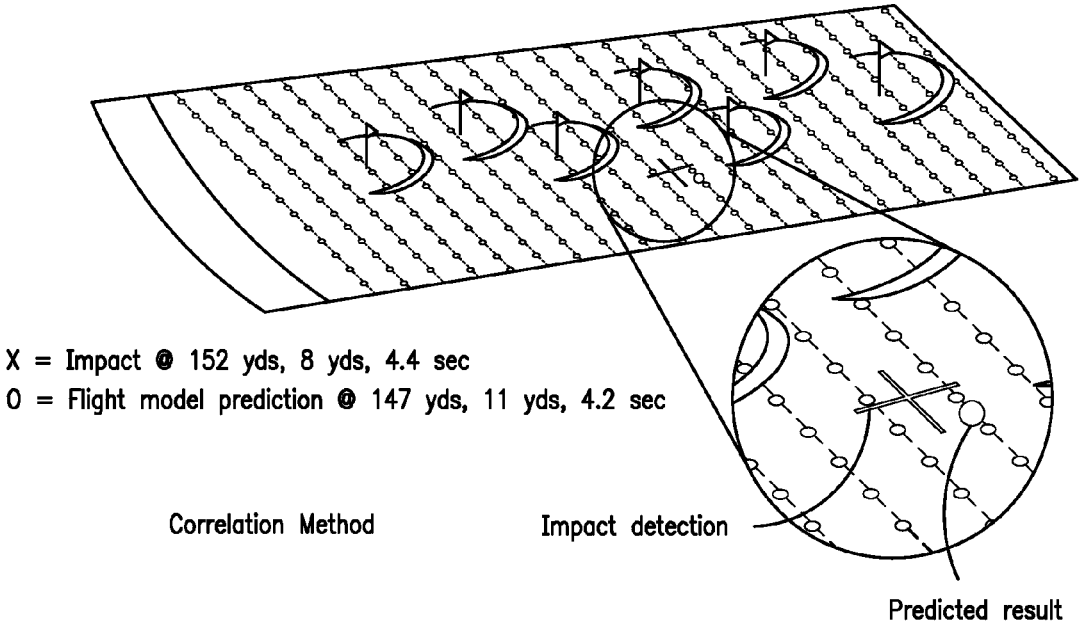
FIG. 6 is a pictorial representation of a target field including targets with ball impact points and times being determined by both the impact detection method using the sensor grid and the flight modeler.
Figure 7:
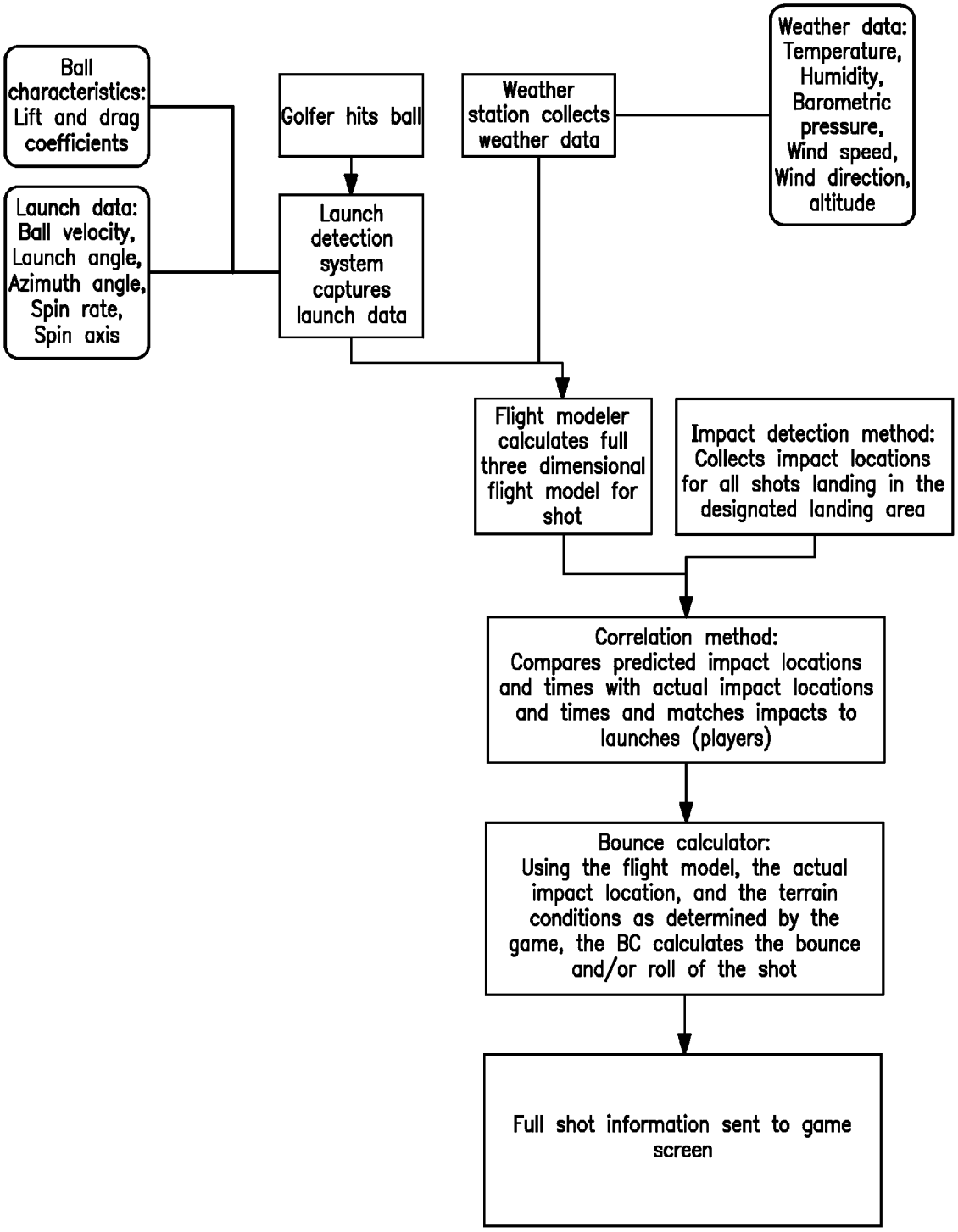
FIG. 7 is a flow chart describing one aspect of the invention.
Figure 8:
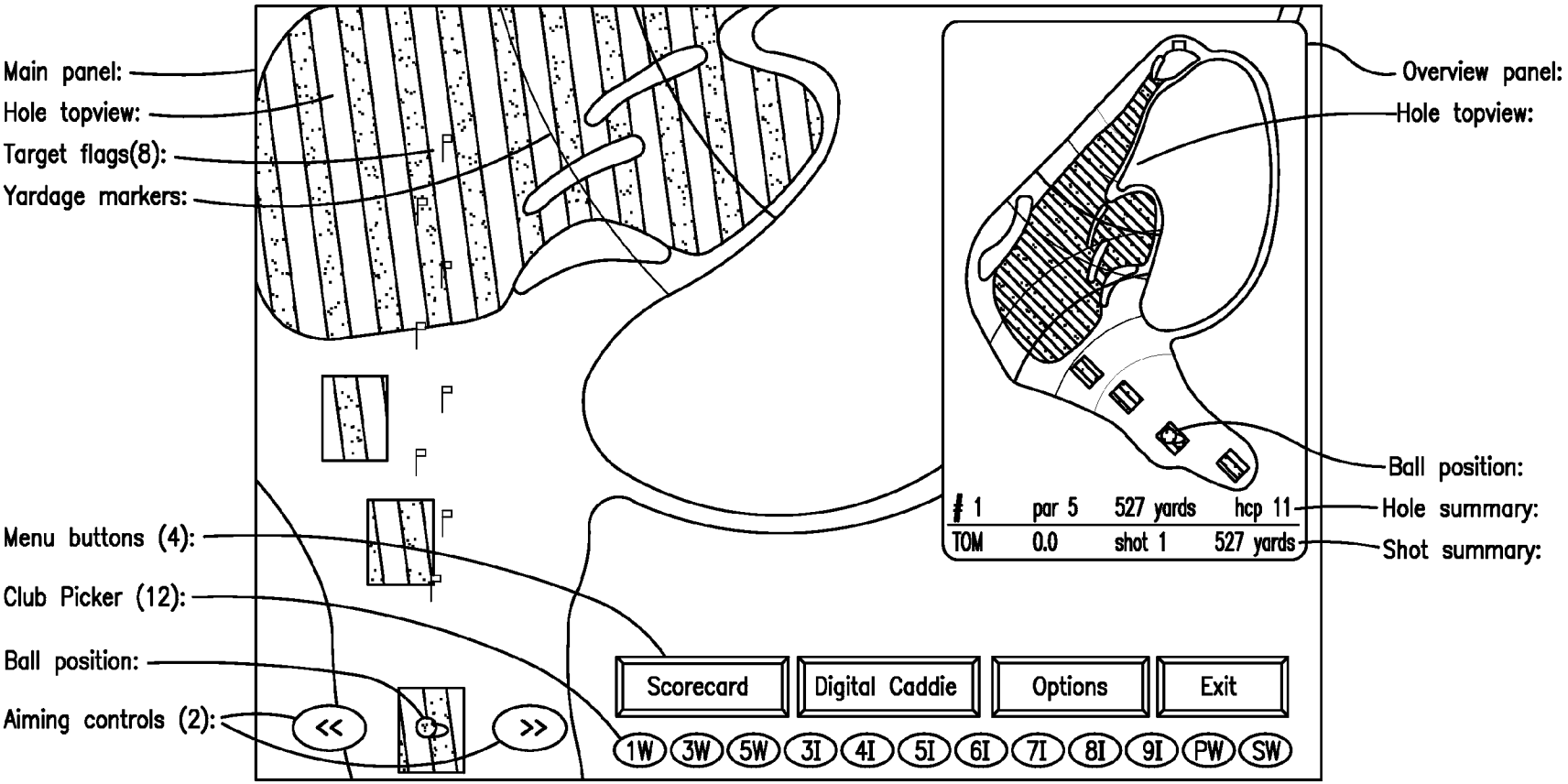
FIG. 8 is a graphical representation of a display of the golf game.
Figure 9:
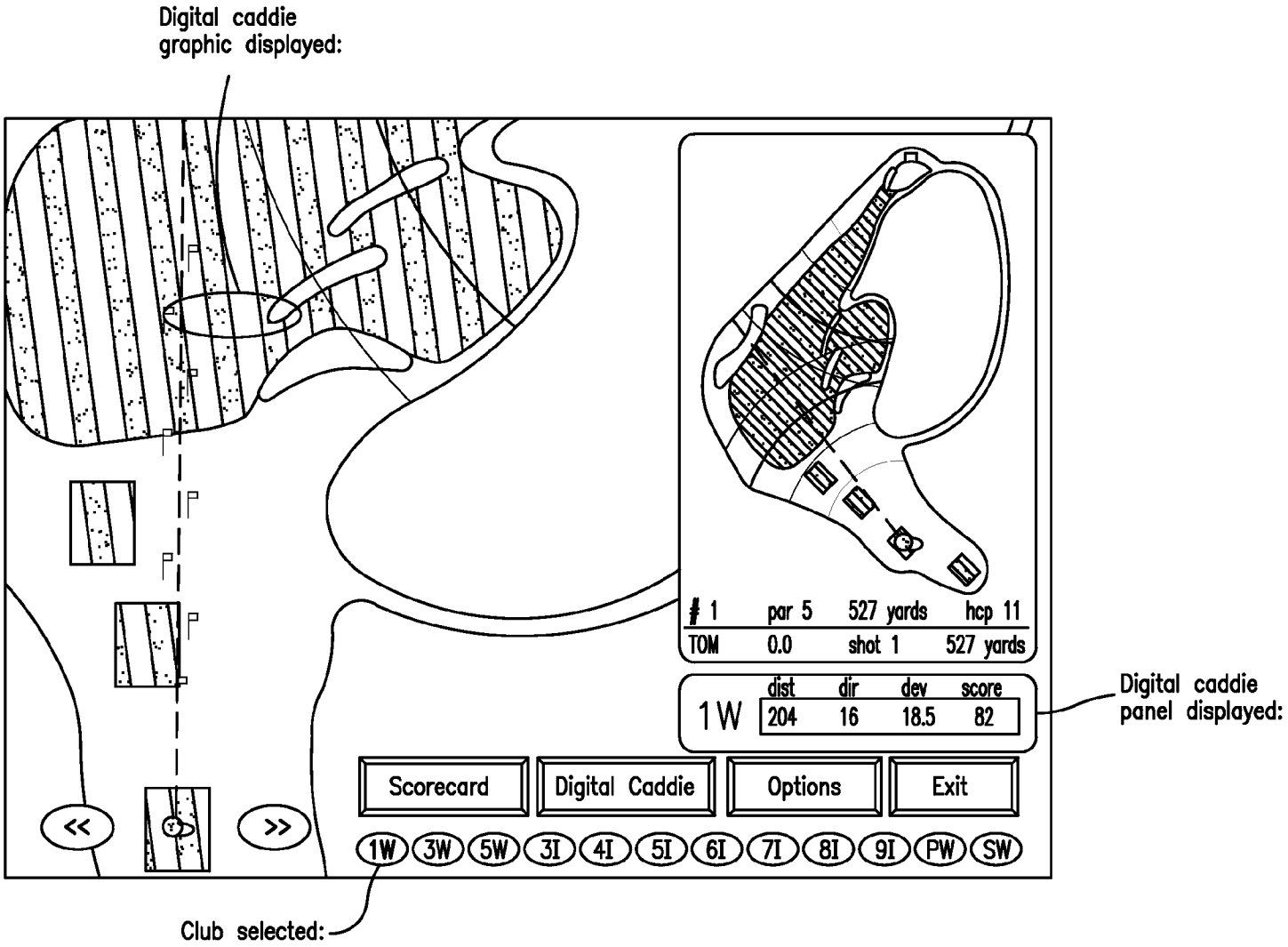
FIG. 9 is a graphical representation of a display of the golf game including a club selection feature.
Figure 10:
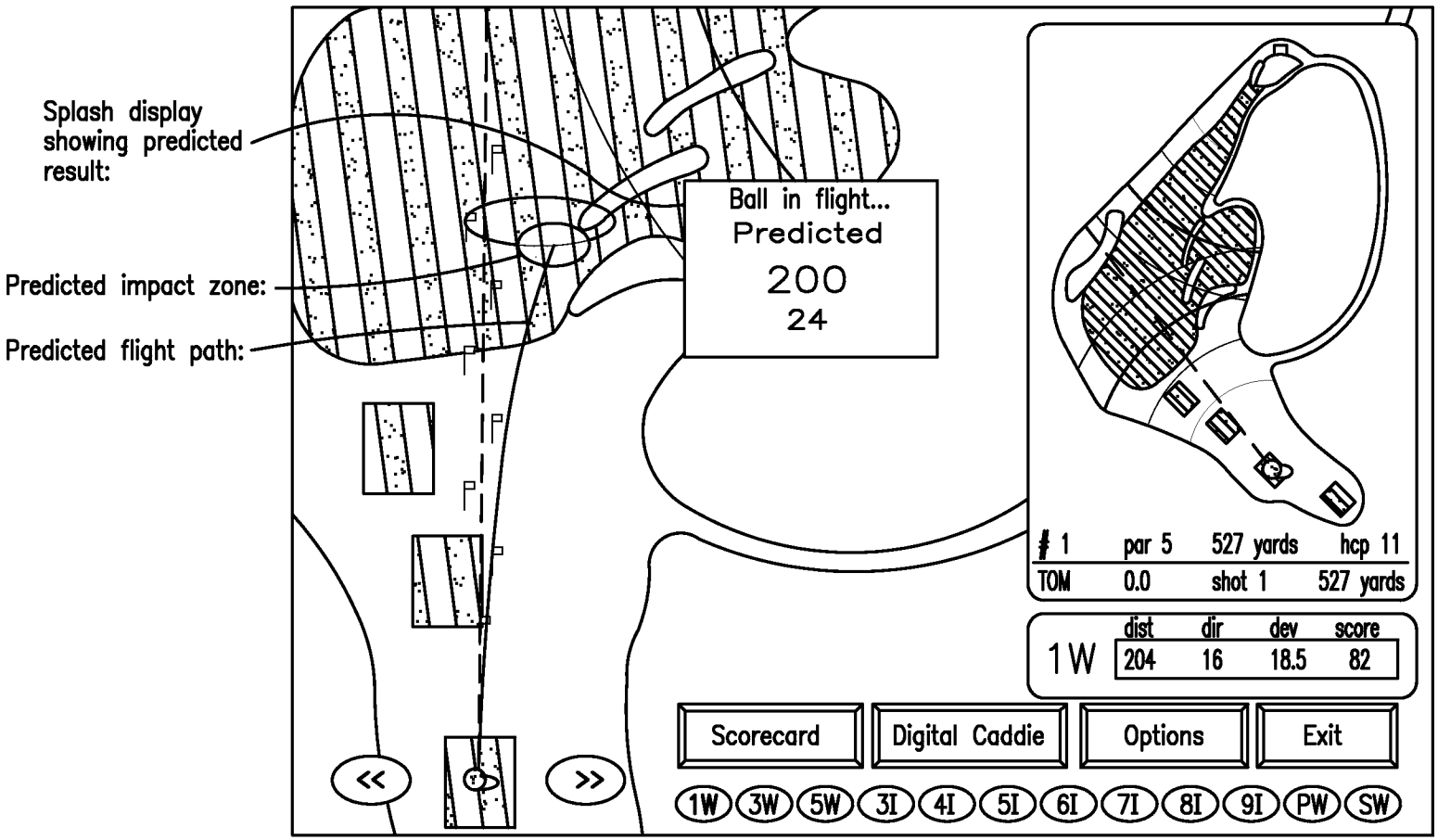
FIG. 10 is a graphical representation of a display of the golf game showing instantaneous display of the predicted flight path, distance and direction of a struck ball that is still in the air.
Figure 11:
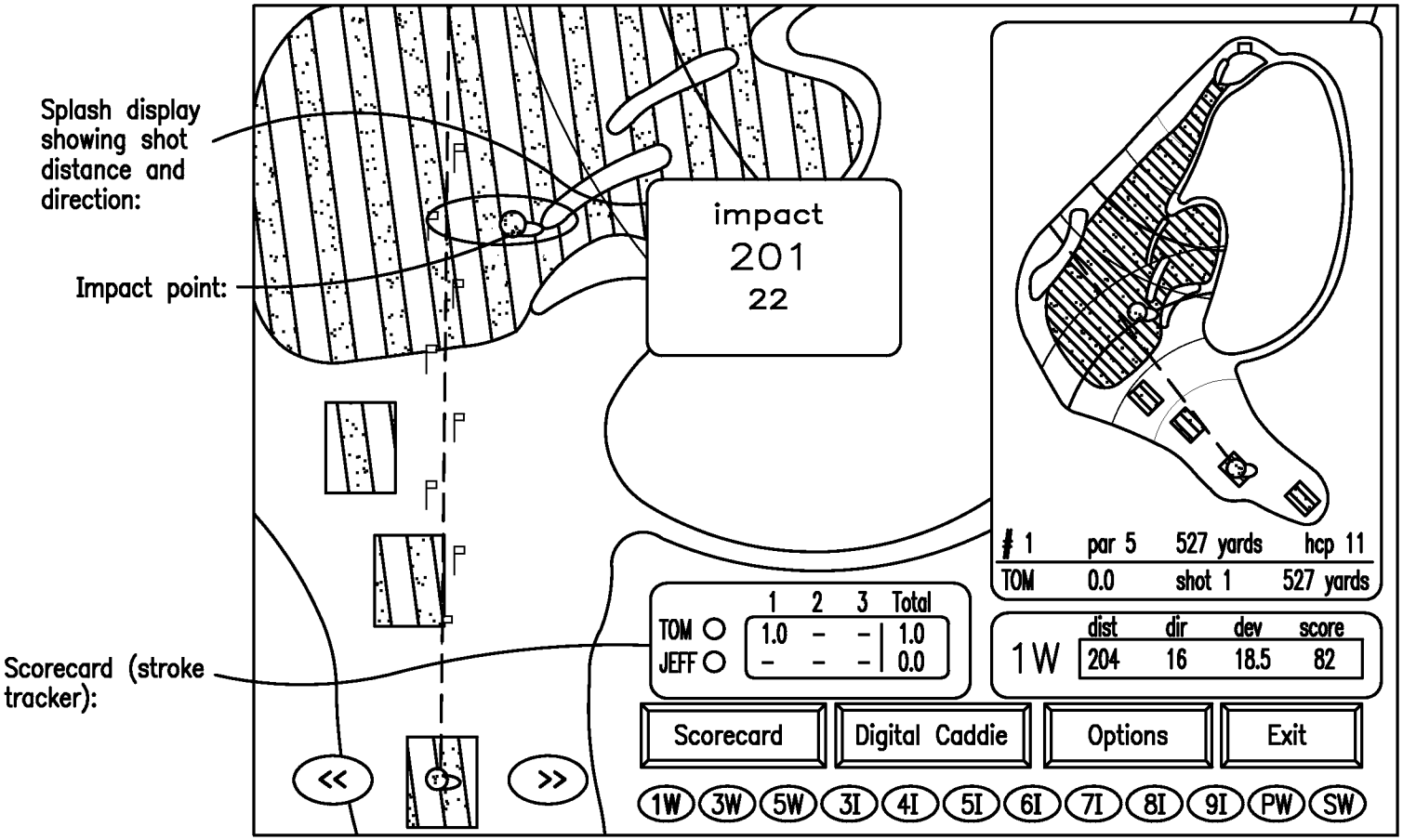
FIG. 11 is a graphical representation of a display of the golf game showing the actual impact position, distance and direction of a completed shot.
Figure 12:
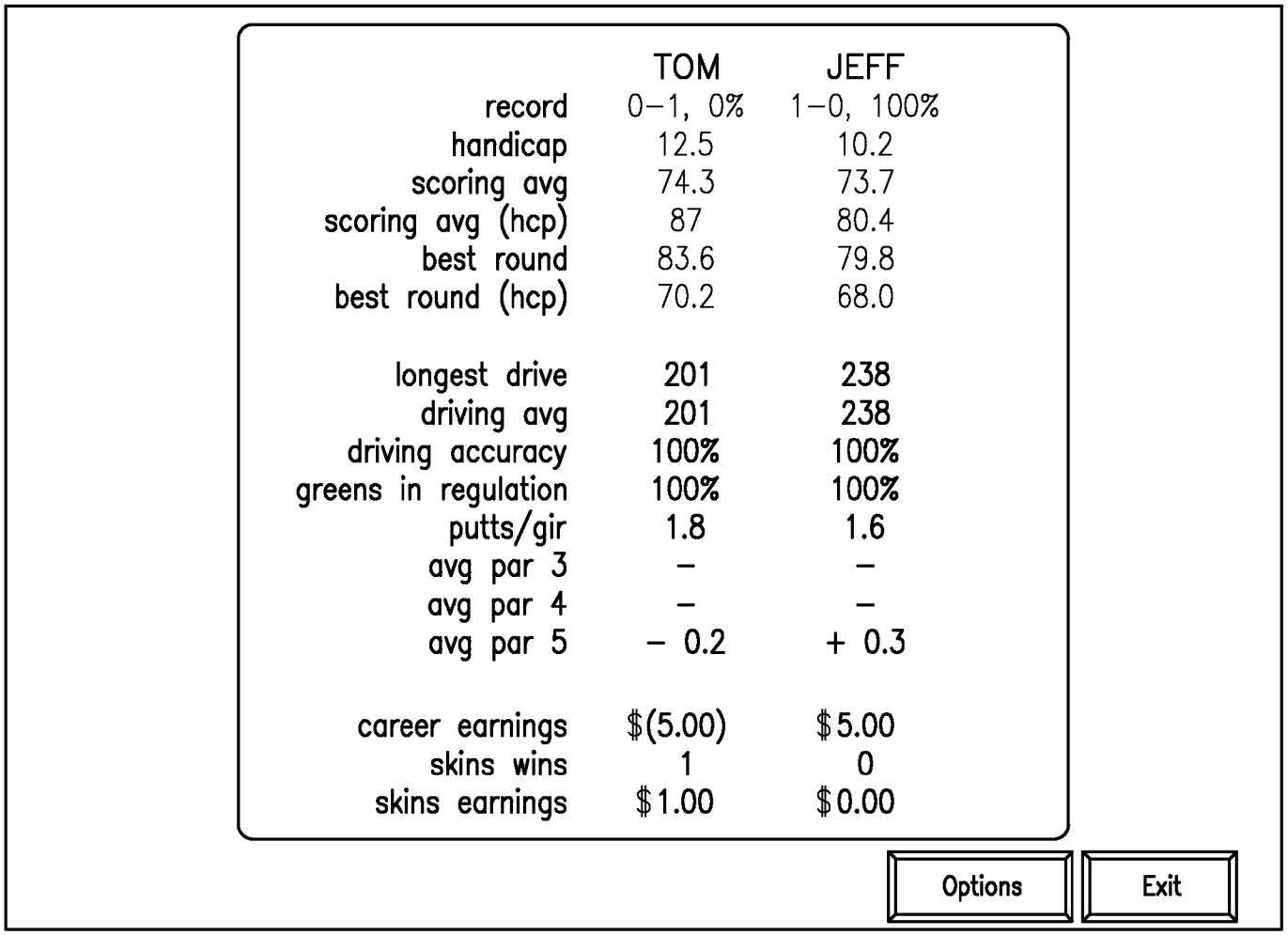
FIG. 12 is a graphical representation of a results display of the golf game.

In various aspects, a tee area is considered to include an LMS where all or part of the components of the LMS are physically within the tee area or where all or part of the LMS is physically outside of the tee area. Accordingly, in one aspect, an LMS may be located within the tee area and proximate to the tee site, for example, near the point of clubhead-to-ball contact as shown in FIG. 2. However, in other aspects, all or part of the components of the LMS may not be physically within the tee area, but rather, configured to sense areas beyond the initial launch point of the ball from the tee area. For instance, the LMS may be configured and/or located to monitor parameters of ball flight or club swing from up to 25' or more in front of the tee area and the parameters being used to generate a flight model of the ball.

Further, each tee area may include one or more LMSs, each LMS including one or more of a variety of sensors and sensor types. For example, the launch monitor system for use in the present invention may include one or more of a variety of sensors and sensor types, such as both an optical sensor net and acoustical detectors for detecting and communicating to one or more data processors, the movement parameters of the struck golf ball or the golf club used to strike the ball.

The LMS is configured to detect one or more parameters associated with striking a golf ball. In various embodiments of the present inventions, one or more parameters can be obtained by one or more launch monitors regarding the behavior of the struck ball. These parameters may include, without being limited to, one or more of the following parameters: the time from the impact of the club head on the target ball to the exit of the target ball from the detection zone, the velocity of the target ball, the trajectory of the target ball within the detection zone, the direction of spin of the target ball, the rate of spin of the target ball, the angular momentum of the target ball, the axis of spin of the target ball, the azimuth angle of the ball, the lift and drag coefficients of the ball, the brand of the ball, the ambient temperature, the relative humidity, the ambient density of the local air, the wind direction, the angle of ascent of the target ball, the angle of descent of the target ball, and the wind velocity and wind density in the target area.

In other embodiments of the present inventions, one or more parameters can be obtained by one or more launch monitors regarding the swing of a golf club used to strike a ball. These parameters may include, without being limited to, one or more of the following parameters: club head measurements, club head location at impact, club head speed, face angle, loft angle, swing path, rotation speed and rotation direction.

A variety of different LMSs which incorporate a variety of sensors and methods for monitoring and collecting parameters of a struck golf ball have been described in the art. Accordingly, in one aspect, the LMS for use with the present installations, methods and systems can be adapted and arranged from commercially available models. Such models typically include a combination of sensors including acoustic (for impact and trigger timing), and optical (video cam, frame grabber, and strobe lights). However, a variety of detection and monitoring sensors and methods may be utilized in the LMS of the present inventions. For example, the LMS may utilize one or more of the following technical options for detection and monitoring: radio-wave measurement, light-wave measurement, photo-optical position sensing, acoustic measurement, capacitive proximity-sensing, inductive proximity-sensing, active transponders, passive transponders, color-determinative optical sensing, pattern-determinative optical sensing, and any combination thereof.

Once the data is collected by the LMS including the parameters related to a golf ball being struck by a golf club, a processor including software means for flight modeling is used to generate a flight model of the ball flight path. The processor may be an integral component of the LMS or may be physically separate from the LMS. The gathered data is processed via flight modeling software and may be reported in various forms, integrated with other data, or stored via the software-facilitated components of the inventions. The flight model generated from the data gathered by the LMS includes a variety of predicted parameters of the flight of the golf ball including parameters such as a predicted trajectory, a predicted landing position, and a predicted landing time of the golf ball. The predicted landing time (i.e. flight time), predicted trajectory, and predicted landing position of the golf ball may be utilized to "open up" (listen to) the impact sensor array, or a portion thereof that covers the field shortly before ball impact is predicted, and to close it again after ball impact has occurred (or failed to do so, in the event the ball is struck out of the grid). Thus, time-gating the impact sensor array may be used to reject ball (or other object) impacts from sources other than the tee site where the ball was struck. The flight model and the data gathered by the LMS can further be used as part of a filtering algorithm to discount multiple impacts of a single ball in the sensor field. Additionally, weather sensor inputs may be used to further refine the flight-path calculations, including wind direction and velocity, as well as air-density estimates from temperature, barometric pressure, and humidity data.

In another aspect, using the data obtained from the launch monitor, a virtual image of the ball flight path can be presented to the players and observers within a very short period of time, for example 5-100 milliseconds, or no more than one second after the ball is struck. Thus, a series of immediate virtual images can be provided each time the first player strikes a ball at an installation according to the invention.

Similarly, images of the golfer's swing can be recorded and played back through the same monitors. Moreover, the virtual data gathered by the launch monitor can be integrated with the camera data to present a composite image of the first player's performance, for example, on a stroke-by-stroke basis.

Examples of various LMS and/or flight modeling devices, methods and software which may be used in the present invention, or modified for use with the present invention are described in U.S. Pat. Nos. 6,821,209, 6,758,759, 6,561,917, 6,431,990, 6,241,622, 6,042,483, 6,011,359, 5,626,526, 5,575,719, 5,568,250, 5,486,002, 5,481,355, 5,471,383, 5,342,051, 4,770,527, and 4,652,121, incorporated herein by reference.

Components of the system further include one or a plurality of sensor arrays forming a network called an impact detection system (IDS), that are distributed in a predetermined pattern in course target areas, each of which sensors and arrays generates signals indicative of the impact, location and roll parameters of an impacting ball. Launch monitor, flight model and sensor array data are processed immediately via game processor software. Data processing and local and remote graphics displays are facilitated by a game processor adapted and connected for receiving and processing signals generated by the sensors and for determining a location of projectile impact relative to the locations of sensors in the target area and for generating an electrical data location signal. The game processor functions to integrate all the data sets that are generated from the LMS, the IDS, and data generated during processing the data according to the methods of the invention. The system may further include storage means to store and access historical data of players or courses and newly generated data by players. The components of the system are linked via a network to facilitate conveyance of data and information from the LMS and IDS to the game processor and optionally, the Internet. Communication via the network may be through various means including, for example, radio-wave, light-wave (i.e. optical fiber), and sound-wave communication (i.e. ultrasonic or ultrasound) or any combination thereof.

Actual impact data of one or more balls impacting in the target field is collected via one or more IDSs. In various aspects of the present inventions, an IDS may include one or more sensor means disposed in a network within or proximate to the target field and configured to determine the actual impact times and actual impact locations of one or more simultaneously impacting balls. The actual impact times and actual impact locations of balls determined via the IDS may then be correlated with the flight model to determine a true impact position for a particular golf shot.

In accordance with the present inventions, one or more sensor-grids are adapted and arranged within the field portion of the installation to gather impact data of all balls impacting all or part of the target field. In one embodiment, the sensor grids include one or more different types of sensors that may be buried within the target field depending on the type of sensor. Accordingly, in one embodiment, sensors for use with an installation of the inventions include those which operate based on acoustic and/or vibrational sensing. Sound waves traveling principally through the ground, with the characteristic speed-of-sound in mixed-composition soils, is used to determine both when and where balls land by software means including a triangulation algorithm. Impact sensing may be accomplished using other sensors and other means, including, but not limited to: radio-wave measurement, light-wave measurement, acoustic measurement, capacitive proximity-sensing, inductive proximity-sensing, active transponders and passive transponders. Use of software means including triangulation algorithms to determine actual ball positions and impact times may be used for all types of sensors anticipated. Thus the impact position of a struck golf ball is preferably determined by triangulation means cooperating with a sensor array on the target area.

The IDS may further include software means for filtering impact data to reduce false impacts and thus increase accuracy of the determined impacts. As such, in one embodiment, the impact data gathered by the IDS is processed via software means including one or more filtering algorithms to eliminate "background noise" increasing the accuracy of the generated impact positions and impact times before the results are further processed and correlated with the flight model to determine the actual impact location and time of the ball struck by a particular player.

Examples of various IDSs, methods and software which may be used in the present invention, or modified for use with the present invention are described in U.S. Pat. Nos. 6,974,391, 6,367,800, 6,322,455, 6,012,987, 5,562,285, 5,516,113, 5,439,224, 5,419,565, 5,393,064, 5,163,677, 5,056,068, 5,033,745, 5,029,866, 4,949,972, 4,898,388, 4,673,183, 4,141,557, 4,045,023, 3,990,708, 3,897,947, and 3,727,069 incorporated herein by reference, such as including a camera raised above the target area.

As another advantage, to facilitate detection and monitoring of the target ball, the ball may include at least one discrete identifier. Discrete identifiers according to the invention include, for example, means for inductive proximity-sensing, active transponders and passive transponders. Passive transponders include, for example, at least one unique radio frequency identification (RFID) in each ball or a unique bar code label. Preferably, at least some of the sensor means of the IDS are configured to read, process and discriminate data of a first RFID of a golf ball and discriminate the data of the first RFID of the ball from an RFID of another golf ball.

In various aspects of the invention, the true impact position of the struck ball is calculated from analyzing impact data determined by the IDS. A processor including software means is provided to correlate the predicted flight model with the impact data to determine the true impact position of a particular ball. In one embodiment, a correlation algorithm is provided which compares the predicted impact locations and times of the flight model with actual impact locations and times of balls impacting within the sensor network of the IDS to determine the true impact position of the particular balls of interest, for example, the ball struck by a particular golfer from a specific tee area. Correlating the flight model for a particular ball with gathered impact data enables determination of the actual impact position for the particular ball. Thus, even where multiple balls impact on the target field simultaneously, correlation enables the real impact position of one of the balls to be determined.

Parameters of the correlation algorithm may be set such that when there are no detected impact positions for balls within a given margin of error between the predicted impact position and time for a ball as determined by the flight model, and impact positions for balls as determined by the IDS, the algorithm uses the predicted landing position as the true impact position. This may occur, for example, when a struck ball does not land on the target field, but rather is struck errantly causing the ball to leave the golf installation entirely. In effect, when there is no impact detected by the IDS for a ball that was detected as struck by the LMS, the predicted impact position of the flight model is used as the true impact position. Likewise, if a flight model fails to be generated for a particular shot, the output of the LMS (i.e. one or more parameters of the golf ball or golf club) may be used directly to determine the true impact position of a struck ball.

In various aspects of the invention, a processor is provided including software means for generating additional positional data of a struck ball and integrating the additional data, the flight model of the ball, and the true impact position on the target field to generate a set of integrated golfer performance data. In one embodiment, the additional positional data allows for simulation of a bounce and roll distance which may be added to the true impact position of a struck golf ball to thereby recreate a golf shot. The golf ball roll and bounce distance may take into account a predetermined type of golf course surface upon which the struck golf ball initially impacts. In one embodiment, a processor with software means is provided to integrate the flight model, the true impact position of the ball and the additional positional data to predict the final segments of travel of the golf ball and a final position of the ball using a bounce and roll calculator algorithm either on an actual or virtual target field.

In various embodiments, generating the additional positional data further includes analyzing one or more factors including one or more parameters of the struck ball or golf club detected by the LMS, actual target field characteristics, and virtual target field characteristics. The virtual target field may include computer generated courses or virtual representations of historical or existing golf courses throughout the world. The actual and virtual target field characteristics may include such factors as the three-dimensional topography of the terrain, type of the terrain, and frictional characteristics of the terrain. The type of the terrain and the frictional characteristics of the terrain may be determined by the type of playing surface.

Accordingly, in certain embodiments of the invention, the actual and virtual target field characteristics may include the topography, the texture of the terrain, and the relative frictional characteristics of the terrain. For example, textures of the terrain may be described as native grass, fairway grass, first cut rough, second cut rough, primary rough, putting surface, putting fringe, sand trap, water, bare ground, and the like. Additionally, the relative frictional characteristics of the terrain may be determined by the texture of terrain and the condition of the terrain, for example, the degree of saturation or wetness of the terrain from extremely wet conditions to extremely dry conditions.

A golfing installation of the present inventions, may be adapted and arranged such that the golfing installation further comprises a plurality of tee sites. Each of the tee sites may optionally be provided with at least one launch monitor and at least one presentation interface. In additional aspects of the invention, a tee site may further include one or more ball dispensers.

In yet additional aspects of the present group of inventions, data from one or more presentations can be used to play a golfing game based on real shots and that data is made available to the players or observers via a computerized network such as the Internet. As the present system can be adapted and arranged, players using the system can play against themselves or other real, historical or fictional players in real time, or can play against them in many different sequences.

One or more high-resolution graphics displays are connected with the processor via the network for receiving the location signal and for immediately displaying to the golfer or other observer a representation of the path and trajectory of the ball, the location of ball impact in the target area, and one or more performance evaluations or comparisons.

In various aspects of the invention, a graphic or other presentation of a player's integrated performance data is presented locally via a presentation interface to one or more players or observers at the installation or accessible via the Internet. In various embodiments, the presentation or representation may include one or more graphic representations, numerical representations, audio representations, video representations, and any combination thereof. The representation is accessible to one or more players or observers, and the presentation is made available to the players or observers via a computerized network such as the Internet.

All related performance data with respect to a first player, or with respect to a group of players, can be stored in any amenable storage means, and can also be made available at one or more later times to the players or observers via a computerized network such as the Internet. The stored data may be used, for example, to calculate a statistical measurement of a golfer's performance, calculate a handicap or make recommendations in a future game of a club type for a future golf shot.

In other aspects, statistical measurements may be calculated and used to determine a prognostication of the number of future shots required to complete a hole. For example, non-integer short game/putting computations may be generated based on data such as the tee to green performance of a player, an average golfer of any specific handicap, or an individual (such as a specific professional golfer).

Additionally, stored results generated in steps of the present invention, such as integrated performance data or the output representations may further be compared and processed to facilitate gaming and competition between a golfer and the golfer's historical results, between one or more golfer's whether playing simultaneously or not, and between one or more golfers using the same tee, different tees in the same facility, or different tees in a different facility as the golfer. As used herein, "historical results" is intended to include not only data generated by golfer's playing at golf installations, but also results measured during play on a real golf course (such as a PGA Tour stop). Thus, the present inventions facilitate competition between one or more golfers and the historical results of the one or more golfers or the historical results of a particular famous golfer.

Both local and remote player access are provided with local (physical game-site) access being provided by one or more tee areas. As such, the invention relates to competitive games played remotely via simultaneous or contemporaneous communications via the Internet between two or more players at two or more installations. Thus, a player in the United States can contemporaneously compete with one or more players in remote locations, such as India and Japan.

Although the invention has been described with reference to the above example, it will be understood that modifications and variations are encompassed within the spirit and scope of the invention. Accordingly, the invention is limited only by the following claims.

What is claimed is:

1. A competitive, multi-player golf method comprising:

a. a golfing installation comprising:
   - i. at least one tee area comprising a launch monitoring system (LMS),
   - ii. a target field comprising an impact detection system (IDS), wherein the IDS comprises at least one or more sensors disposed in a network within or above the target field, b. a multi-player golf method comprising:
   - i. first golfer swinging and striking a first golf ball with a golf club in the tee area;
   - ii. detecting via the LMS one or more parameters of the struck golf ball;
   - iii. analyzing via flight modeling software the parameter(s) of the struck golf ball and/or the swing of the golf club to calculate a flight model for predicting the trajectory, landing position, and landing time of the golf ball,
   - iv. if the golf ball lands in the target field, gathering impact data via the IDS, wherein the impact data comprises an impact landing position and impact time;
   - v. correlating the flight model with the impact data to determine a true impact position for the golf ball;
   - vi. simulating the final segments of travel of the golf ball by applying additional positional data to the true impact position and/or the flight model, wherein said additional positional data comprises virtual target field characteristics and said virtual target field characteristics comprise computer-generated topography, texture of a terrain in said target field, and/or relative frictional characteristics of a terrain in said target field, wherein said virtual target field characteristics comprise the terrain, type of terrain, frictional characteristics, or any combination thereof from a historical or existing golf course;
   - vii. integrating the flight model, the true impact position with additional positional data to generate performance data;
   - viii. comparing the performance data of the first golfer with the performance data of an additional historical golfer; and
   - ix. generating a representation of the performance of the first golfer and said additional historical golfer, wherein the performance of said additional historical golfer is at a real golf course at a PGA Tour stop.

2. The method of claim 1, wherein the one or more parameters of the first golf ball is selected from the group consisting of: time from impact of the club head on the ball to exit of the ball from a detection zone, velocity of the ball, trajectory of the ball within a detection zone, direction of spin of the ball, rate of spin of the ball, angular momentum of the ball, axis of spin of the ball, azimuth angle of the ball, lift and drag coefficients of the ball, brand of the ball, ambient temperature, barometric pressure, relative humidity, wind direction, angle of ascent of the ball, angle of descent of the ball, wind velocity, and wind density.

3. The method of claim 1, wherein the sensor includes radio-wave measurement, light-wave measurement, acoustic measurement, capacitive proximity-sensing, inductive proximity-sensing, active transponders, passive transponders, or any combination thereof.

4. The method of claim 1, wherein the first tee area further comprises a golf ball dispenser.

5. The method of claim 1, wherein the first golf ball comprises an inductive proximity-sensing device, an active transponder, passive transponders, or any combination thereof.

6. The method of claim 5, wherein the passive transponder is a radio frequency identification (RFID) tag and the one or more sensors are configured to read, process and discriminate data of a first RFID of the first golf ball and discriminate the data of the first RFID from an RFID of another golf ball.

7. The method of claim 1, wherein the representation is a graphic representation, numerical representation, audio representation, video representation, or any combination thereof.

8. The method of claim 7, wherein the representation is made visually available via a computerized network.

9. The method of claim 8, wherein the computerized network is the Internet.

10. The method of claim 8, wherein the representation and integrated performance data are stored and made available at one or more later times to the first golfer via a computerized network.

11. The method of claim 10, wherein the representation, integrated performance data, or any combination thereof, is used to calculate a statistical measurement of the first golfer's performance.

12. The method of claim 11, wherein the statistical measurement is used to determine a handicap or recommend a club type for a future golf shot.

13. The method of claim 11, wherein the statistical measurement is used to determine a prognostication of required number of future shots to complete a hole.

14. A competitive, multi-player golf method comprising:

a. detecting via a launch monitoring system (LMS) one or more parameters of a first golf ball struck by a first golf club by a first golfer within a first tee area, one or more parameters of a swing of the first golf club used to hit the first golf ball, or any combination thereof, wherein the one or more parameters of the first golf ball is selected from the group consisting of: time from impact of the club head on the ball to exit of the ball from a detection zone, velocity of the ball, trajectory of the ball within a detection zone, direction of spin of the ball, rate of spin of the ball, angular momentum of the ball, axis of spin of the ball, azimuth angle of the ball, lift and drag coefficients of the ball, brand of the ball, ambient temperature, barometric pressure, relative humidity, wind direction, angle of ascent of the ball, angle of descent of the ball, wind velocity, and wind density; and wherein the one or more parameters of the golf club swing is selected from the group consisting of: club head measurements, club head location at impact, club head speed, face angle, loft angle, swing path, rotation speed and rotation direction;

b. detecting via a LMS one or more parameters of a second golf ball struck by a second golf club by a second golfer that is different from said first golfer within the first or a second tee area, one or more parameters of a swing of the second golf club used to hit the second golf ball, or any combination thereof, wherein said first and second golf balls each comprise a passive transponder comprising a radio frequency identification (RFID) tag and the one or more sensors are configured to read, process and discriminate data of a first RFID of the first golf ball and discriminate the data of the first RFID from an RFID of said second golf ball;

c. analyzing via software for flight modeling the one or more parameters of the first golf ball, the swing of the first golf club, or any combination thereof, to calculate a first flight model comprising a predicted trajectory, a predicted landing position, and a predicted landing time of the first golf ball;

d. analyzing via software for flight modeling the one or more parameters of the second golf ball, the swing of the second golf club, or any combination thereof, to calculate a second flight model comprising a predicted trajectory, a predicted landing position, and a predicted landing time of the second golf ball;

e. gathering impact data via an Impact Detection System (IDS) for each ball landing in a target field, said IDS comprising one or more sensors disposed in a network within or above the target field, the impact data comprising an impact landing position in the target field and an impact time for each ball that impacts the terrain within the network, wherein the impact data represents actual target fold characteristics comprising three-dimensional topography of the terrain, type of terrain, and functional characteristics of the terrain;

f. correlating the first and second flight model with the impact data to determine a true impact position for the first golf ball and the second golf ball;

g. generating additional positional data for the first golf ball and the second golf ball by analyzing the first and second flight models and the true impact positions for the first golf ball and the second golf ball;

h. integrating the first and second flight models and the true impact positions for the first golf ball and the second golf ball with additional positional data and virtual target field characteristics for the first and second golf balls to generate a set of integrated performance data for the first golf ball and the second golf ball;

i. comparing the integrated performance data of the first golf ball of said first golfer with the integrated performance data of the second golf ball of said second golfer to obtain results that discriminate between the first golfer and the second golfer;

j. generating a graphic, numerical, audio or visual representation of the results of steps h and i, and presenting the representation on a computerized network wherein said virtual target field characteristics are variable and comprise virtual three-dimensional topography of terrain, virtual type of terrain, virtual frictional characteristics of terrain, or any combination thereof; and k. providing said first and second golfer with a recommendation of a club type for a future golf shot;

l. providing a prognostication of the number of short game/putting shots for completing a hole, wherein said a prognostication is in the form of a non-integer computation based on past performance or on a handicap of said first and second golfer;

m. comparing the performance data of the first golfer with the performance data of an additional historical golfer in real time; and n. generating a representation of the performance of the first golfer and said additional historical golfer, wherein the performance of said additional historical golfer is at a real PGA Tour stop golf course.

15. The method of claim 14, wherein the one or more parameters of the first golf club swing is selected from the group consisting of: club head measurements, club head location at impact, club head speed, face angle, loft angle, swing path, rotation speed and rotation direction.

16. The method of claim 14, wherein the one or more parameters of the first golf ball and/or the first and/or second golf club swing is detected using radio-wave measurement, light-wave measurement, photo-optical position sensing, acoustic measurement, capacitive proximity-sensing, inductive proximity-sensing, active transponders, passive transponders, color-determinative optical sensing, pattern-determinative optical sensing, or any combination thereof.

17. A competitive, multi-player golf method comprising:

a. a golfing installation comprising:

i. at least one tee area comprising a launch monitoring system (LMS), ii. a target field comprising an impact detection system (IDS), wherein the IDS comprises at least one or more sensors disposed in a network within or above the target field, b. a multi-player golf method comprising:

i. first golfer swinging and striking a first golf ball with a golf club in the tee area;

ii. detecting via the LMS
one or more parameters of the struck golf ball;

iii. analyzing via flight modeling software the parameter(s) of the struck golf ball and/or the swing of the golf club to calculate a flight model for predicting the trajectory, landing position, and landing time of the golf ball, iv. if the golf ball lands in the target field, gathering impact data via the IDS, wherein the impact data comprises an impact landing position in the actual terrain of the target field and an impact time for each ball that impacts the target field, wherein the actual target field characteristics comprise at least one member selected from the group consisting of three-dimensional topography of the terrain, type of terrain, and functional characteristics;

v. correlating the flight model with the impact data to determine a true impact position for the golf ball;

vi. simulating the final segments of travel of the golf ball by applying additional positional data to the true impact position and/or the flight model, wherein said additional positional data comprises virtual target field characteristics and said virtual target field characteristics comprise computer-generated topography, texture of a terrain in said target field, and/or relative frictional characteristics of a terrain in said target field, wherein said virtual target field characteristics comprise the terrain, type of terrain, frictional characteristics, or any combination thereof from a historical or existing golf course;

vii. integrating the flight model, the true impact position with additional positional data to generate performance data;

viii. providing said first golfer with a recommendation of a club type for a future golf shot;

ix. comparing the performance data of the first golfer with the performance data of an additional historical golfer; and x. generating a representation of the performance of the first golfer and historical golfer, wherein the performance of said additional historical golfer is at a real golf course at a real PGA Tour stop.

* * * * *